US008265310B2

(12) United States Patent
Berardi et al.

(10) Patent No.: US 8,265,310 B2
(45) Date of Patent: Sep. 11, 2012

(54) MULTI-ELEMENT DIRECTIONAL ACOUSTIC ARRAYS

(75) Inventors: William Berardi, Grafton, MA (US); Hilmar Lehnert, Framingham, MA (US)

(73) Assignee: Bose Corporation, Framingham, MA (US)

( * ) Notice: Subject to any disclaimer, the term of this patent is extended or adjusted under 35 U.S.C. 154(b) by 176 days.

(21) Appl. No.: 12/716,309

(22) Filed: Mar. 3, 2010

(65) Prior Publication Data

US 2011/0216924 A1 Sep. 8, 2011

(51) Int. Cl.
*H04R 5/02* (2006.01)

(52) U.S. Cl. ..... 381/300; 381/335

(58) Field of Classification Search ..... 381/300, 381/332, 333, 302, 339, 98, 99, 86, 57–59, 381/150, 182, 1, 17, 18, 335; 181/175, 198, 181/199

See application file for complete search history.

(56) References Cited

U.S. PATENT DOCUMENTS

| | | | |
|---|---|---|---|
| 1,755,636 | A | 4/1930 | Dubilier |
| 2,293,181 | A | 8/1942 | Terman |
| 2,789,651 | A | 4/1957 | Daniels |
| 3,378,814 | A | 4/1968 | Butler |
| 3,486,578 | A | 12/1969 | Albariono |
| 3,768,589 | A | 10/1973 | Nilsson |
| 3,940,576 | A | 2/1976 | Schultz |
| 4,340,778 | A | 7/1982 | Cowans et al. |
| 4,616,731 | A | 10/1986 | Robinson |
| 4,628,528 | A | 12/1986 | Bose et al. |
| 4,747,142 | A | 5/1988 | Tofte |
| 4,930,596 | A | 6/1990 | Saiki et al. |
| 4,942,939 | A | 7/1990 | Harrison |
| 4,965,776 | A | 10/1990 | Mueller |
| 5,012,890 | A | 5/1991 | Nagi et al. |
| 5,105,905 | A | 4/1992 | Rice |
| 5,197,100 | A | 3/1993 | Shiraki |
| 5,197,103 | A | 3/1993 | Hayakawa |
| 5,261,006 | A | 11/1993 | Nieuwendijk et al. |
| 5,280,229 | A | 1/1994 | Faude et al. |
| 5,373,564 | A | 12/1994 | Spear et al. |
| 5,375,564 | A | 12/1994 | Gail |
| 5,426,702 | A | 6/1995 | Aarts |
| 5,528,694 | A | 6/1996 | Van De Kerkhof et al. |
| 5,610,992 | A | 3/1997 | Hickman |
| 5,673,329 | A | 9/1997 | Wiener |
| 5,732,145 | A | 3/1998 | Tsao |
| 5,740,259 | A | 4/1998 | Dunn |
| 5,802,194 | A | 9/1998 | Yamagishi et al. |
| 5,809,153 | A * | 9/1998 | Aylward et al. ..... 381/337 |

(Continued)

FOREIGN PATENT DOCUMENTS

| | | | |
|---|---|---|---|
| EP | 0608937 | A1 | 8/1994 |

(Continued)

OTHER PUBLICATIONS

Boone, Marinus, M. et al.; "Design of a Highly Directional Endfire Loudspeaker Array". J. Audio Eng. Doc., vol. 57, No. 5, May 2009. pp. 309-325.

(Continued)

*Primary Examiner* — Xu Mei
*Assistant Examiner* — Lun-See Lao

(57) ABSTRACT

An audio system that may be implemented in a television, that includes a plurality of directional arrays. The arrays may include a common acoustic driver and may be spaces non-uniformly.

15 Claims, 7 Drawing Sheets

U.S. PATENT DOCUMENTS

| | | | | |
|---|---|---|---|---|
| 5,815,589 | A | 9/1998 | Wainwright et al. | |
| 5,821,471 | A | 10/1998 | McCuller | |
| 5,828,759 | A | 10/1998 | Everingham | |
| 5,832,099 | A | 11/1998 | Wiener | |
| 5,864,100 | A | 1/1999 | Newman | |
| 5,870,484 | A * | 2/1999 | Greenberger | 381/300 |
| 5,881,989 | A | 3/1999 | O'Brien et al. | |
| 5,940,347 | A | 8/1999 | Raida et al. | |
| 6,002,781 | A | 12/1999 | Takayama et al. | |
| 6,067,362 | A | 5/2000 | Lemanski et al. | |
| 6,075,868 | A | 6/2000 | Goldfarb et al. | |
| 6,144,751 | A | 11/2000 | Velandia | |
| 6,173,064 | B1 | 1/2001 | Anagnos | |
| 6,223,853 | B1 | 5/2001 | Huon et al. | |
| 6,255,800 | B1 | 7/2001 | Bork | |
| 6,275,595 | B1 | 8/2001 | Lundgren et al. | |
| 6,278,789 | B1 | 8/2001 | Potter | |
| 6,356,643 | B2 | 3/2002 | Yamagishi et al. | |
| 6,359,994 | B1 | 3/2002 | Markow et al. | |
| 6,374,120 | B1 | 4/2002 | Krauss | |
| 6,415,036 | B1 | 7/2002 | Ritter et al. | |
| 6,431,309 | B1 | 8/2002 | Coffin | |
| 6,477,042 | B1 | 11/2002 | Allgeyer et al. | |
| 6,597,794 | B2 | 7/2003 | Cole et al. | |
| 6,694,200 | B1 | 2/2004 | Naim | |
| 6,704,425 | B1 | 3/2004 | Plummer | |
| 6,741,717 | B2 | 5/2004 | Dedieu et al. | |
| 6,744,903 | B1 | 6/2004 | Jeon et al. | |
| 6,771,787 | B1 | 8/2004 | Hoefler et al. | |
| 6,820,431 | B2 | 11/2004 | McManus et al. | |
| 6,870,933 | B2 | 3/2005 | Roovers | |
| 6,928,169 | B1 | 8/2005 | Aylward | |
| 6,963,647 | B1 | 11/2005 | Krueger et al. | |
| 7,016,501 | B1 | 3/2006 | Aylward et al. | |
| 7,155,214 | B2 | 12/2006 | Struthers et al. | |
| 7,212,467 | B2 | 5/2007 | Dobbins | |
| 7,283,634 | B2 | 10/2007 | Smith | |
| 7,490,044 | B2 | 2/2009 | Kulkarni | |
| 7,542,815 | B1 | 6/2009 | Berchin | |
| 8,175,311 | B2 | 5/2012 | Aylward | |
| 2001/0001319 | A1 | 5/2001 | Beckert et al. | |
| 2001/0031059 | A1 | 10/2001 | Borgonovo | |
| 2001/0039200 | A1 | 11/2001 | Azima et al. | |
| 2002/0073252 | A1 | 6/2002 | Arbiter et al. | |
| 2002/0085730 | A1 | 7/2002 | Holland | |
| 2002/0085731 | A1 | 7/2002 | Aylward | |
| 2002/0115480 | A1 | 8/2002 | Huang | |
| 2002/0150261 | A1 | 10/2002 | Moeller et al. | |
| 2002/0171567 | A1 | 11/2002 | Altare et al. | |
| 2002/0194897 | A1 | 12/2002 | Arnott et al. | |
| 2003/0063767 | A1 | 4/2003 | Dedieu et al. | |
| 2004/0173175 | A1 | 9/2004 | Kostun et al. | |
| 2004/0204056 | A1 | 10/2004 | Phelps | |
| 2004/0234085 | A1 | 11/2004 | Lennox | |
| 2005/0018839 | A1 | 1/2005 | Weiser | |
| 2005/0078831 | A1 | 4/2005 | Irwan et al. | |
| 2005/0205348 | A1 | 9/2005 | Parker et al. | |
| 2005/0239434 | A1 | 10/2005 | Marlowe | |
| 2005/0255895 | A1 | 11/2005 | Lee et al. | |
| 2006/0013411 | A1 | 1/2006 | Lin | |
| 2006/0046778 | A1 | 3/2006 | Hembree | |
| 2006/0046780 | A1 | 3/2006 | Subramaniam et al. | |
| 2006/0065479 | A1 | 3/2006 | Okawa et al. | |
| 2006/0134959 | A1 | 6/2006 | Ellenbogen | |
| 2006/0181840 | A1 | 8/2006 | Cvetko | |
| 2006/0250764 | A1 | 11/2006 | Howarth et al. | |
| 2006/0253879 | A1 | 11/2006 | Lin | |
| 2007/0002533 | A1 | 1/2007 | Kogan et al. | |
| 2007/0014426 | A1 | 1/2007 | Sung et al. | |
| 2007/0015486 | A1 | 1/2007 | Marlowe | |
| 2007/0035917 | A1 | 2/2007 | Hotelling et al. | |
| 2007/0036384 | A1 | 2/2007 | Struthers et al. | |
| 2007/0086606 | A1 * | 4/2007 | Goodwin | 381/116 |
| 2007/0217633 | A1 | 9/2007 | Copeland et al. | |
| 2007/0226384 | A1 | 9/2007 | Robbin et al. | |
| 2007/0239849 | A1 | 10/2007 | Robbin et al. | |
| 2007/0247794 | A1 | 10/2007 | Jaffe et al. | |
| 2007/0269071 | A1 | 11/2007 | Hooley | |
| 2007/0286427 | A1 | 12/2007 | Jung et al. | |
| 2008/0232197 | A1 | 9/2008 | Kojima et al. | |
| 2009/0016555 | A1 | 1/2009 | Lynnworth | |
| 2009/0157575 | A1 | 6/2009 | Schobben et al. | |
| 2009/0225992 | A1 * | 9/2009 | Konagai | 381/17 |
| 2009/0304189 | A1 | 12/2009 | Vinton | |
| 2010/0092019 | A1 | 4/2010 | Hoefler et al. | |
| 2010/0290630 | A1 * | 11/2010 | Berardi et al. | 381/17 |
| 2011/0096950 | A1 | 4/2011 | Rougas et al. | |
| 2012/0121118 | A1 | 5/2012 | Fregoso et al. | |

FOREIGN PATENT DOCUMENTS

| | | | |
|---|---|---|---|
| EP | 0624045 | | 11/1994 |
| EP | 1185094 | A2 | 3/2002 |
| EP | 1527801 | A3 | 5/2005 |
| EP | 1577880 | | 9/2005 |
| EP | 2099238 | * | 9/2009 |
| EP | 2099238 | A1 | 9/2009 |
| EP | 2104375 | A2 | 9/2009 |
| FR | 1359616 | A | 4/1964 |
| FR | 2653630 | A1 | 4/1991 |
| GB | 631799 | A | 11/1949 |
| GB | 2432213 | | 5/2007 |
| JP | 2007037058 | A | 2/2007 |
| WO | 9611558 | A1 | 4/1996 |
| WO | 9820659 | A1 | 5/1998 |
| WO | 9851122 | A1 | 11/1998 |
| WO | 2004075601 | A1 | 9/2004 |
| WO | WO 2004/075601 | * | 9/2004 |
| WO | 2005/104655 | A2 | 11/2005 |
| WO | 2006/130115 | A1 | 12/2006 |
| WO | 2007007083 | A1 | 1/2007 |
| WO | 2007/031703 | A1 | 3/2007 |
| WO | 2007/049075 | A1 | 5/2007 |
| WO | 2007/052185 | | 5/2007 |

OTHER PUBLICATIONS

Van Der Wal, Menno, et al.; "Design of Logarithmically Spaced Constant-Directivity Transducer Arrays". J. Audio Eng. Soc., vol. 44, No. 6, Jun. 1996. pp. 497-507.

Ward, Darren B., et al.; "Theory and Design of Broadband Sensor Arrays with Frequency Invariant Far-field Beam Patterns". J. Acoustic Soc. Am. 97 (2), Feb. 1995. pp. 1023-1034.

Backgrounder; Technical Overview: Zenith/Bose Television Sound System, Summer/Fall 1986, Zenith Electronics Corporation, 1000 Milwaukee Avenue, Glenview, Illinois 60025, 8 pages.

International Search Report and Written Opinion dated Apr. 27, 2011 for PCT/US2011/024674.

Moulton Dave, The Center Channel: Unique and Difficult; TV Technology, Published Oct. 5, 2005. Retrieved May 13, 2009 from: http://www.tvtechnology.com/article/11798.

Rubinson Kalman, Music in the Round #4, Stereophile, Published Mar. 2004; Retrieved May 13, 2009 from http://www.stereophile.com/musicintheround/304round/.

Silva Robert, Surround Sound—What You Need to Know, The History And Basics of Surround Sound, Retrieved May 13, 2009 from http://hometheater.about.com/od/beforeyoubuy/a/surroundsound.htm.

Linkwitz Siegfried, Surround Sound, Linkwitz Lab, Accurate Reproduction and Recording of Auditory Scenes, Revised Publication Jan. 15, 2009. Retreived May 13, 2009 from http://www.linkwitzlab.com/surround_system.htm.

Meier, et al.; Ein linienhafter akustischer Gruppenstrahler mit ausgeglichenen Nebenmaxima, Acustica vol. 17 1966, pp. 301-309.

Holland, K. R., et al., A Low Cost End-Fire Acoustic Radiator, Institute of Sound and Vibration Research, University of Southampton, Southampton S095NH, UK, J. Audio Eng. Soc., vol. 39, No. 7/8, Jul./Aug. 1991, pp. 540-550.

Reams, et al., The Karlson-Hypex Bass Enclosure, AES, An Audio Engineering Society Preprint, presented at the 57th Convention, May 10-13, 1977, Los Angeles, CA.

Olson, Harry F., Directional Microphones, Journal of the Audio Engineering Society, RCA Laboratories, Princeton, NJ, pp. 420-430.

Poppe, Martin C., The K-Coupler, A New Acoustical-Impedance Transformer, IEEE Transactions on Audio and Electroacoustics, pp. 163-167, Dec. 1966.
Korn, T.S., A Corner Loudspeaker with Coaxial Acoustical Line, Journal of the Audio Engineering Society, vol. 5, No. 3, Jul. 1957, pp. 138-141.
Ramsey, Robert C., A New Cardiod-Line Mircrophone, Audio Engineering Society, NY, NY, Oct. 5-9, 1959.
Shulman, Yuri, Reducing Off-Axis Comb Filter Effects in Highly Directional Microphones, Audio Engineering Society, Presented at the 81st Convention, Los Angeles, CA, Nov. 12-16, 1986.
Purolator Acoustic Porous Metals, Acoustic Media for Aviation Applications, Aerospace Acoustic Materials, Acoustic Media for Helicopters, pp. 1-4, http://www.purolator-facet.com/acoustic.htm, May 1, 2008.
www.altecmm.com, Oct. 2003, inMotion portable audio stereo.
www.pcstats.com, Jun. 21, 2004, NoiseControl Novibes III HDD Isolation.
www.reviews.cnet.com, Jul. 23, 2004, Creative Travel sound.
www.jbl.com, Jul. 23, 2004, Creative Travel Sound.
www.earsc.com, Jun. 28, 2004, Stereo Speaker.
Steve Guttenberg, "Altec Lansing InMotion", Internet Citation (online) Jun. 10, 2004 (downloaded Nov. 11, 2006) URL: http://reviews .cnet.com/4505-7869 7-30790793.html.
EP05107420.1 European Search Report dated Nov. 20, 2006.
International Search Report and Written Opinion dated Jul. 15, 2009 for PCT/US2009/039709.
International Search Report and Written Opinion dated Apr. 28, 2009 for PCT/US2009/032241.
Munjal, M. L., Acoustics of Ducts and Mufflers with Application to Exhaust and Ventilation System Design, 1987, pp. 42-152, John Wiley & Sons, New York, NY.
Augspurger, G.L., Loudspeakers on Damped Pipes, J. Audio Eng. Soc., vol. 48, No. 5, May 2000, pp. 424-436, Perception Inc., Los Angeles, CA.
European Examination Report dated Jul. 21, 2008 for EP Appln. No. 02026327.3.
Japanese Office Action dated Feb. 23, 2009 for related JP Application No. H11-250309.
International Preliminary Report on Patentability dated Feb. 18, 2010 for PCT/US2009/032241.
Baily, A. R. "Non-resonant Loudspeaker Enclosure Design", Wireless World, Oct. 1965.
International Preliminary Report on Patentability dated May 19, 2010 for PCT/US2009/032241.
International Preliminary Report on Patentability dated Jul. 16, 2010 for PCT/US2009/039709.

* cited by examiner

MULTI-ELEMENT DIRECTIONAL ACOUSTIC ARRAYS

BACKGROUND

This specification describes an audio system that may be implemented in a television, that includes a plurality of directional arrays. The arrays may include a common acoustic driver and may be spaced non-uniformly.

SUMMARY

In one aspect an audio system includes at least three acoustic drivers, arranged substantially in a line, and separated by a non-uniform distance; a first interference directional array, includes a first subset of the plurality of acoustic drivers, for directionally radiating one of a left channel audio signal and a right channel audio signal; and signal processing circuitry to process audio signals to the first subset of acoustic drivers so that radiation from each of the acoustic drivers interferes destructively so that radiation in a direction toward a listening location is less than radiation in other directions; and a second interference directional array, includes a second subset of the plurality of acoustic drivers, for directionally radiating the other of a left channel audio and a right channel audio signal; and signal processing circuitry to process audio signals to the second subset of acoustic drivers so that radiation from each of the acoustic drivers interferes destructively so that radiation in a direction toward a listening location is less than radiation in other directions; the first subset and the second subset includes at least one common acoustic driver. The distance between the two leftmost acoustic drivers of the first directional array may be less than the distance between any other two of the acoustic drivers of the first directional array and the distance between the two rightmost acoustic drivers of the second directional array may be less than the distance between any other two acoustic drivers of the second directional array. The radiating surfaces of the acoustic drivers may face upwardly. The acoustic drivers may face upwardly and backwardly. The radiating surface of the leftmost acoustic driver may face outwardly. The audio system may further include an acoustically opaque barrier in front of the acoustic drivers. The audio system may be implemented in a television. The audio system may further include a first interference directional array that includes a third subset of the plurality of acoustic drivers, for directionally radiating a center channel audio signal; and signal processing circuitry to process audio signals to the third subset of acoustic drivers so that radiation from each of the acoustic drivers interferes destructively so that radiation in one direction is less than radiation in other directions.

In another aspect, a television that includes an audio device, includes at least three acoustic drivers, arranged substantially in a line, and separated by a non-uniform distance; a first interference directional array, includes a first subset of the plurality of acoustic drivers, for directionally radiating one of a left channel audio signal and a right channel audio signal; and signal processing circuitry to process audio signals to the first subset of acoustic drivers so that radiation from each of the acoustic drivers interferes destructively so that radiation in a direction toward a listening location is less than radiation in other directions; and a second interference directional array, includes a second subset of the plurality of acoustic drivers, for directionally radiating the other of a left channel audio and a right channel audio signal; and signal processing circuitry to process audio signals to the second subset of acoustic drivers so that radiation from each of the acoustic drivers interferes destructively so that radiation in a direction toward a listening location is less than radiation in other directions; the first subset and the second subset including at least one common acoustic driver. The distance between the two leftmost acoustic drivers of the first directional array may be less than the distance between any other two of the acoustic drivers of the first directional array and the distance between the two rightmost acoustic drivers of the second directional array may be less than the distance between any other two acoustic drivers of the second directional array. The radiating surfaces of the acoustic drivers may face upwardly. The radiating surfaces of the acoustic drivers may face upwardly and backwardly. The radiating surface of the leftmost acoustic driver may face outwardly. The television system may further include an acoustically opaque barrier in front of the acoustic drivers. A television system may further include a first interference directional array, includes a third subset of the plurality of acoustic drivers, for directionally radiating a center channel audio signal; and signal processing circuitry to process audio signals to the third subset of acoustic drivers so that radiation from each of the acoustic drivers interferes destructively so that radiation in one direction is less than radiation in other directions.

Other features, objects, and advantages will become apparent from the following detailed description, when read in connection with the following drawing, in which:

DETAILED DESCRIPTION

Figure 1:
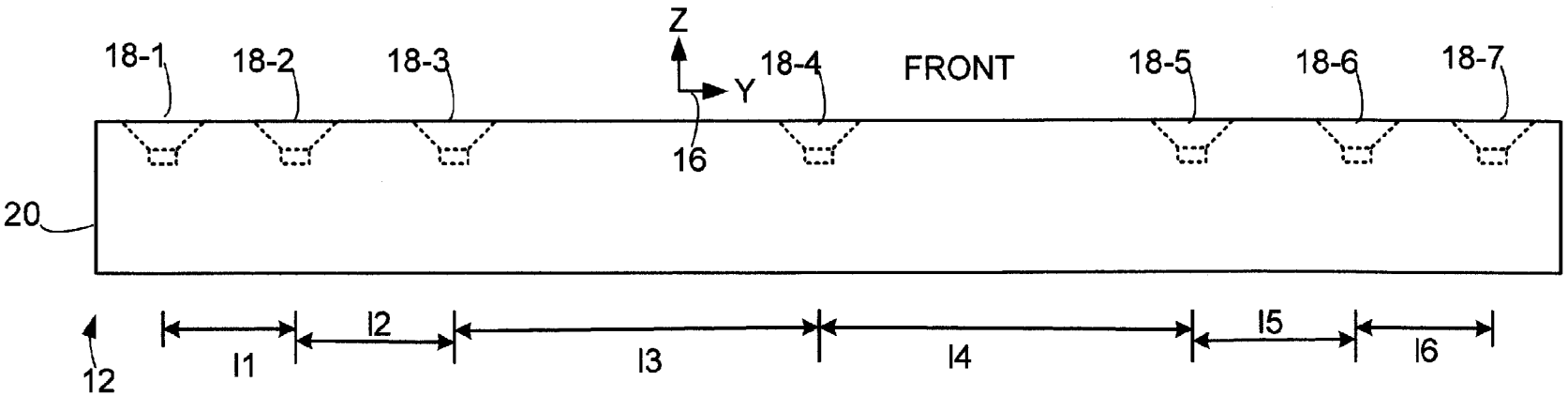
FIG. 1 is a top diagrammatic view and a front diagrammatic view of an audio module.
Figure 1:
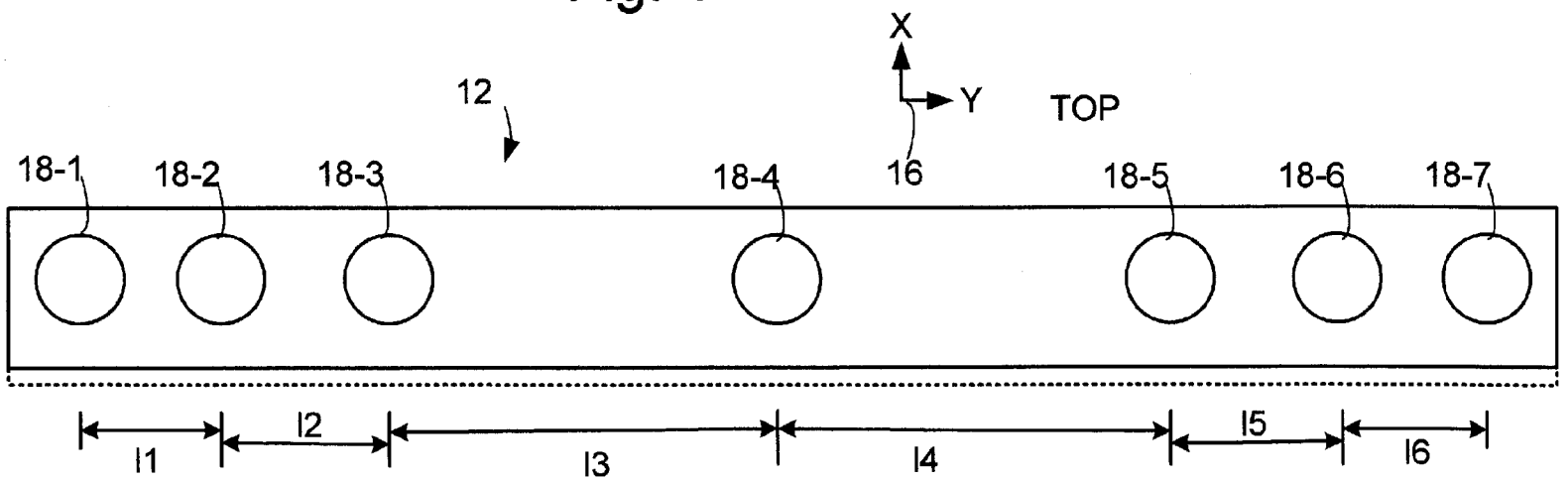

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Operations may be performed by analog circuitry or by a microprocessor executing software that performs the mathematical or logical equivalent to the analog operation. Unless otherwise indicated, signal lines may be implemented as discrete analog or digital signal lines, as a single discrete digital signal line with appropriate signal processing to process separate streams of audio signals, or as elements of a wireless communication system. Some of the processes may be described in block diagrams. The activities that are performed in each block may be performed by one element or by a plurality of elements, and may be separated in time. The elements that perform the activities of a block may be physically separated. Unless otherwise indicated, audio signals or video signals or both may be encoded and transmitted in either digital or analog form; conventional digital-to-analog or analog-to-digital converters may not be shown in the figures. For simplicity of wording "radiating acoustic energy corresponding to the audio signals in channel x" will be referred to as "radiating channel x."

FIG. 1 shows a top view and a front view of an audio module 12 including a plurality, in this embodiment seven, of acoustic drivers 18-1-18-7. One of the acoustic drivers 18-4 is positioned near the lateral center of the module, near the top of the audio module. Three acoustic drivers 18-1-18-3 are positioned near the left extremity 20 of the audio module and are closely and non-uniformly spaced, so that distance $l1 \neq l2$, $l2 \neq l3$, $l1 \neq 3$. Additionally, the spacing may be arranged so that $l1 < l2 < l3$. Similarly, distance $l6 \neq l5$, $l5 \neq l4$, $l6 \neq 4$. Additionally, the spacing may be arranged so that $l6 < l5 < l4$. In one implementation, $l1 = l6 = 55$ mm, $l2 = l5 = 110$ mm, and $l3 = l4 = 255$ mm. The device of FIG. 1 may be a standalone audio device, or may be implemented in a television set, as is shown below. Direction indicator 16 shows the intended orientation of the audio module 12 in use.

Figure 2:
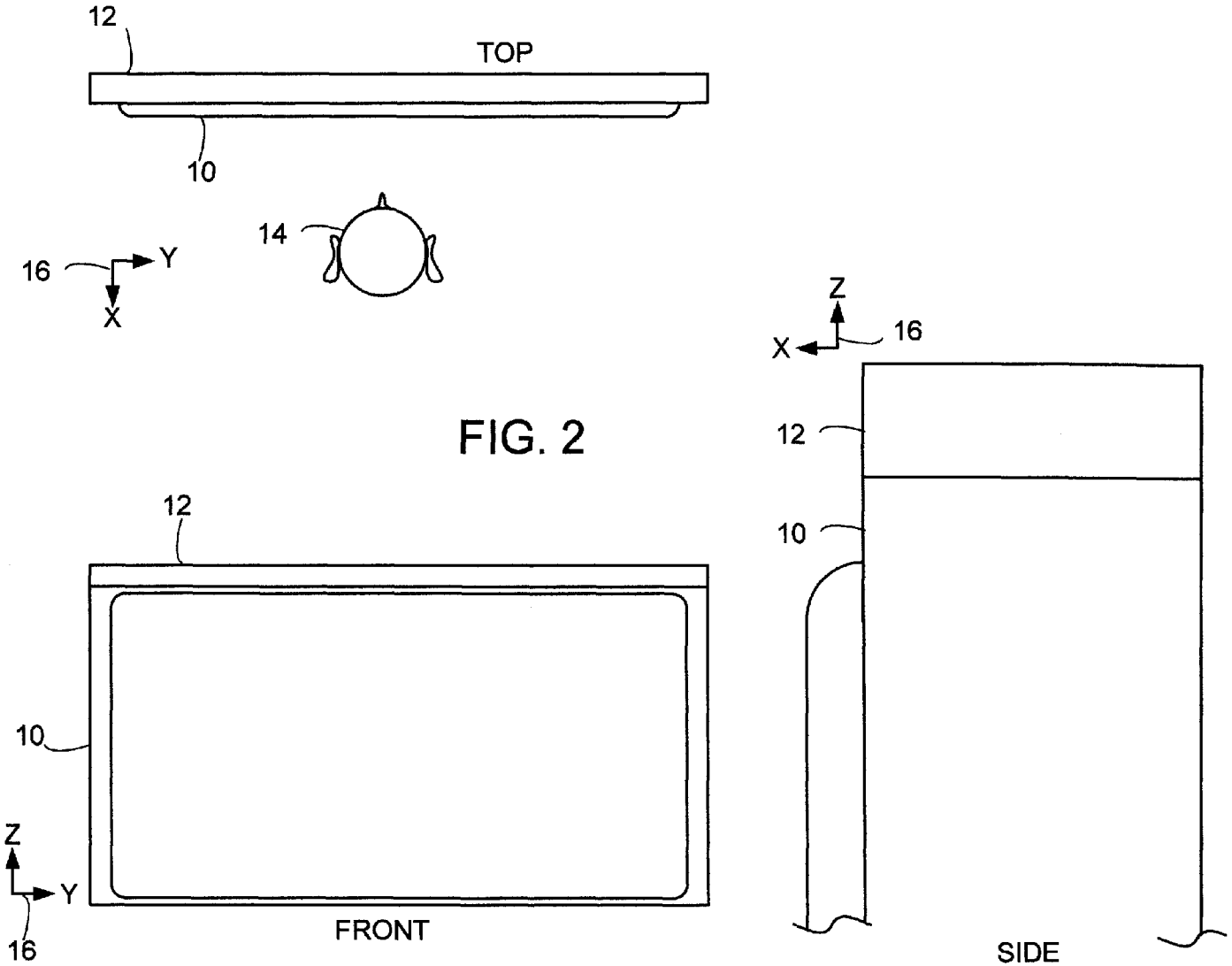
FIG. 2 is a top diagrammatic view, a front diagrammatic view, and a side diagrammatic view of a television including the audio module of FIG. 1.

The audio module 12 of FIG. 1 is particularly beneficial when used with, or integrated in, a television or similar media device. FIG. 2 shows a top view, a side view, and a front view of a television 10 with an audio module 12 of FIG. 1 included in the television console. The audio module is substantially linear and extends horizontally across the television, above the screen. In other implementations, the audio module may be positioned below the screen. More detail of the audio module is shown in subsequent figures. A listener 14 is shown in the top view, which along with direction indicator 16 shows the orientation of the television.

Figure 3A:
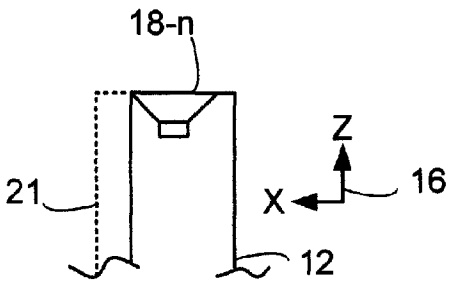
FIGS. 3A and 3B are side diagrammatic views showing one or more of the acoustic drivers of the audio module.
Figure 3B:
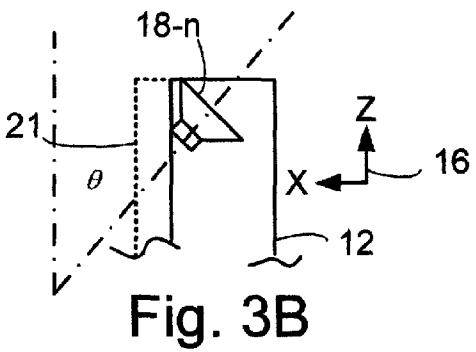
Figure 3C:
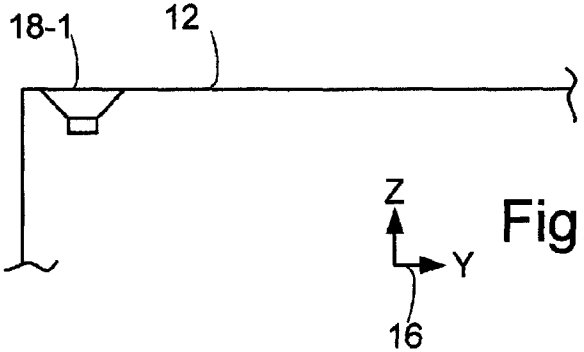
FIG. 3C-3E are front diagrammatic views of an end acoustic driver of the audio module.
Figure 3D:
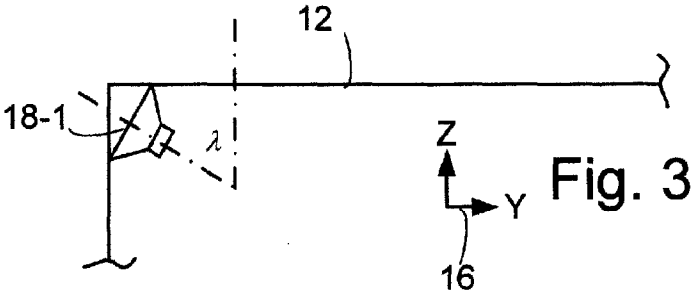
Figure 3E:
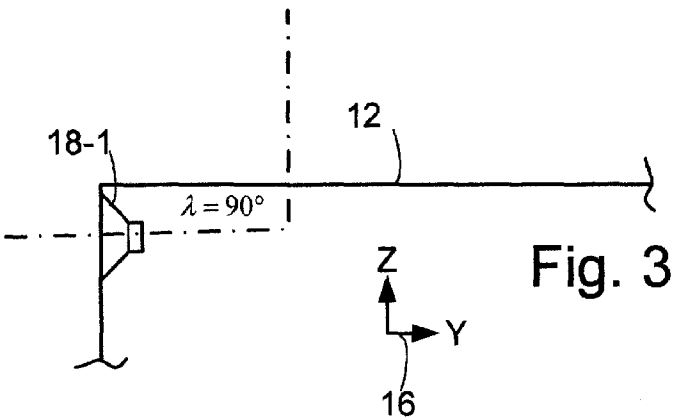

FIGS. 3A-3E show some variations of the orientations of one or more of the acoustic drivers 18-1-18-7. In the side view of FIG. 3A, the acoustic driver **18-*n* (where n=1-7), is upward firing, that is, the radiating surface faces upwards. In the side view of FIG. 3B, the acoustic driver 18-*n* is oriented so that the radiating surface faces upward and backward at an angle θ, greater than 0 degrees and less than 90 degrees, relative to vertical. In the front view of FIG. 3C, the acoustic driver 18-1 closest to the left extremity of the acoustic module 12 is oriented substantially directly upward. In the front view of FIG. 3D, the acoustic driver 18-1 closest to the left extremity of the acoustic module 12 is oriented upward and outward at an angle relative to vertical. In FIG. 3E, the acoustic driver 18-1, angle λ is 90 degrees, so that the acoustic driver is side-firing, that is facing sidewards. The mirror image of FIGS. 3D and 3E can be used with acoustic driver 18-7. The orientation of FIG. 3D can be implemented with acoustic driver 18-2 or 18-3 or both. The mirror image of FIG. 3D can be implemented with acoustic driver 18-5 or 18-6 or both. One or more of the acoustic drivers may be in an orientation that is a combination of the orientations of FIGS. 3A-3E; for example, an acoustic driver may be tilted backward and outward relative to vertical. In one implementation, acoustic drivers 18-2-18-6 are tilted backward so that angle θ is 27±5% degrees and acoustic drivers 18-1 and 18-7** are replaced by a directional speaker such as is described in U.S. Pat. Published Pat. App. 2009/0274329A1, configured so that the radiation is substantially sideward.

Orienting the acoustic drivers according to FIGS. 3A-3E, together with signal processing as described below, causes more or the total acoustic radiation arriving at the listener to be indirect radiation than is the case with conventional audio systems. A greater proportion of the acoustic radiation being indirect radiation results in a desirable spacious acoustic image.

Causing as much as possible of the acoustic radiation experienced by the listener to be indirect radiation is accomplished by forming interference type directional arrays consisting of subsets of the acoustic drivers 18-1-18-7. Interference type directional arrays are discussed in U.S. Pat. No. 5,870,484 and U.S. Pat. No. 5,809,153. At frequencies at which the individual acoustic drivers radiate substantially omnidirectionally (for example frequencies with corresponding wavelengths that are more than twice the diameter of the radiating surface of the acoustic drivers), radiation from each of the acoustic drivers interferes destructively or non-destructively with radiation from each of the other acoustic drivers. The combined effect of the destructive and non-destructive interference is that the radiation is some directions is significantly less, for example, −14 dB, relative to the maximum radiation in any direction. The directions at which the radiation is significantly less than the maximum radiation in any direction will be referred to as "null directions". Causing more radiation experienced by a listener to be indirect radiation is accomplished by causing the direction between the audio module and the listener to be a null direction.

At frequencies with corresponding wavelengths that are less than twice the diameter of the radiating surface of an acoustic driver, the radiation pattern becomes less omnidirectional and more directional, until at frequencies with corresponding wavelengths that are equal to or less than the diameter of the radiating surface of an acoustic driver, the radiation patterns of the individual driver becomes inherently directional. At these frequencies, there is less destructive and non-destructive interference between the acoustic drivers of the array, and the acoustic image tends to collapse to the individual acoustic drivers. However, if the acoustic drivers are oriented according to FIGS. 3A-3E, even at frequencies with corresponding wavelengths that are equal to or less than the diameter of the radiating surface, the listener experiences indirect radiation. A result is that the perceived source is diffuse and somewhere other than at the acoustic driver. In addition, the barrier 21 deflects radiation so that it reaches the listener indirectly. The barrier has the additional advantage that it hides the acoustic drivers and protects them from damage from the front of the television.

Figure 4A:
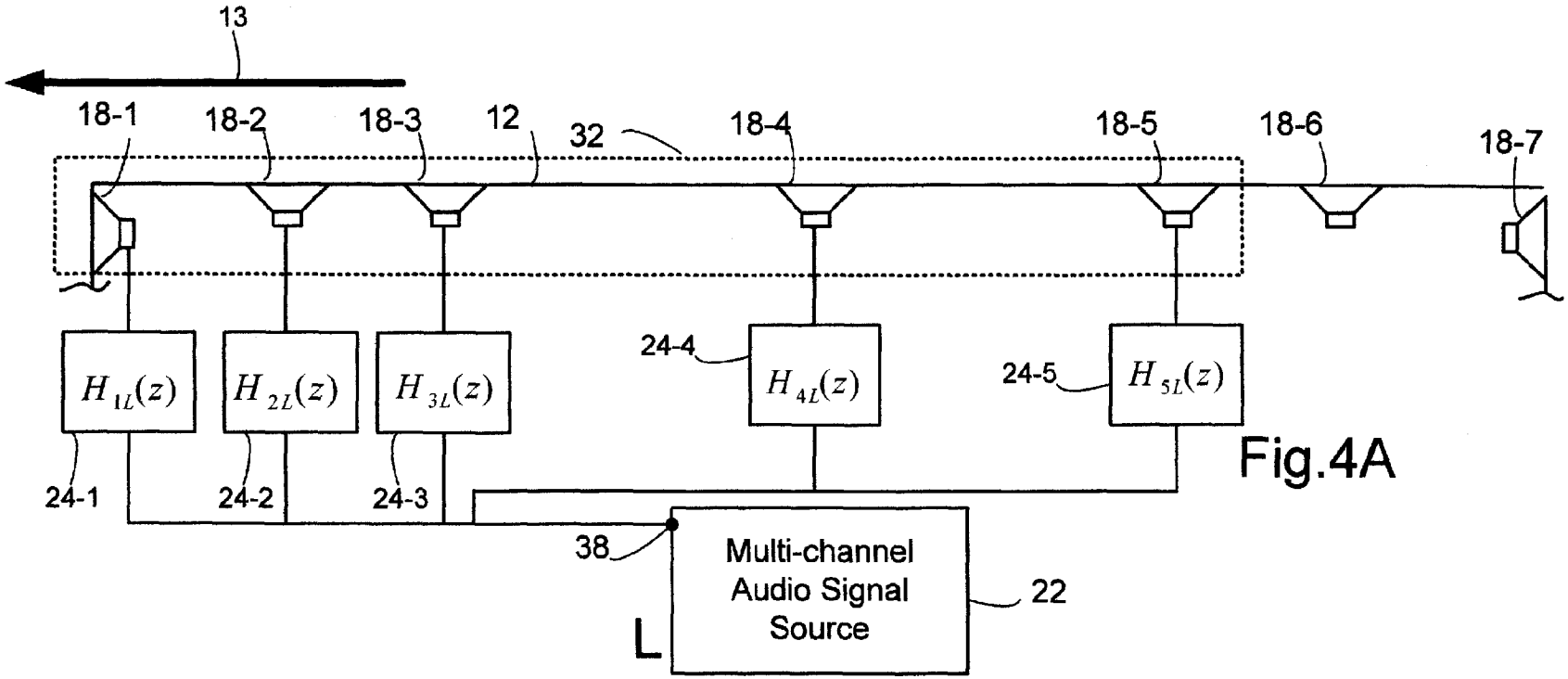
FIGS. 4A-4D are each diagrammatic views of the audio module, showing the configuration of one of the directional arrays.

FIG. 4A shows a diagrammatic view of audio module 12, showing the configuration of directional arrays of the audio module. The audio module is used to radiate the channels of a multi-channel audio signal source 22. Typically, a multi-channel audio signal source for use with a television has at least a left (L), right (R), and Center (C) channel. In FIG. 4A, the left channel array 32 includes acoustic drivers 18-1, 18-2, 18-3, 18-4, and 18-5. The acoustic drivers 18-1-18-5 are coupled to the left channel signal source 38 by signal processing circuitry 24-1-24-5, respectively that apply signal processing represented by transfer function $H_{1L}(z)$-$H_{5L}(z)$, respectively. The effect of the transfer functions $H_{1L}(z)$-$H_{5L}(z)$ on the left channel audio signal may include one or more of phase shift, time delay, polarity inversion, and others. Transfer functions $H_{1L}(z)$-$H_{5L}(z)$ are typically implemented as digital filters, but may be implemented with equivalent analog devices.

In operation, the left channel signal L, as modified by the transfer functions $H_{1L}(z)$-$H_{5L}(z)$ is transduced to acoustic energy by the acoustic drivers 18-1-18-5. The radiation from the acoustic drivers interferes destructively and non-destructively to result in a desired directional radiation pattern. To achieve a spacious stereo image, the left array 32 directs radiation toward the left boundary of the room as indicated by arrow 13 and cancels radiation toward the listener. The use of digital filters to apply transfer functions to create directional interference arrays is described, for example, in Boone, et al., *Design of a Highly Directional Endfire Loudspeaker Array*, J. Audio Eng. Soc., Vol 57. The concept is also discussed with regard to microphones van der Wal et al., *Design of Logarithmically Spaced Constant Directivity-Directivity Transducer Arrays*, J. Audio Eng. Soc., Vol. 44, No. 6, June 1996 (also discussed with regard to loudspeakers), and in Ward, et al., *Theory and design of broadband sensor arrays with frequency invariant far-field beam patterns*, J. Acoust. Soc. Am. 97 (2), February 1995. Mathematically, directional microphone array concepts may generally be applied to loudspeakers.

Figure 4B:
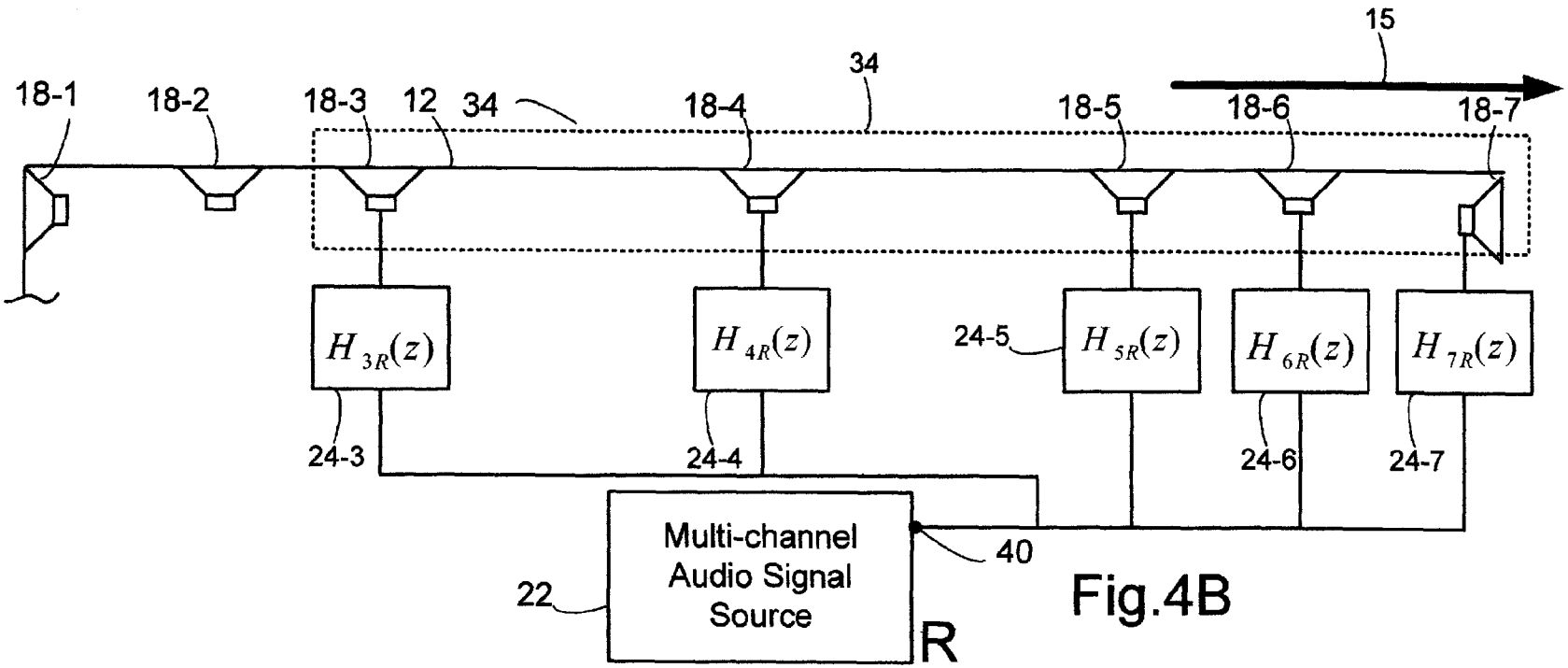

Similarly, in FIG. 4B, the right channel array 34 includes acoustic drivers 18-3, 18-4, 18-5, 18-6, and 18-7. The acoustic drivers 18-3-18-7 are coupled to the right channel signal source 40 but signal processing circuitry 24-3-24-7, respectively that apply signal processing represented by transfer function $H_{3R}(z)$-$H_{7R}(z)$, respectively. The effect of the transfer functions $H_{3R}(z)$-$H_{7R}(z)$ may include one or more of phase shift, time delay, polarity inversion, and others. Transfer functions $H_{3R}(z)$-$H_{7R}(z)$ are typically implemented as digital filters, but may be implemented with equivalent analog devices.

In operation, the left channel signal L, as modified by the transfer functions $H_{3R}(z)$-$H_{7R}(z)$ is transduced to acoustic energy by the acoustic drivers 18-3-18-7. The radiation from the acoustic drivers interferes destructively and non-destructively to result in a desired directional radiation pattern. To achieve a spacious stereo image, the right array 34 directs radiation toward the right boundary of the room as indicated by arrow 15 and cancels radiation toward the listener.

Figure 4C:
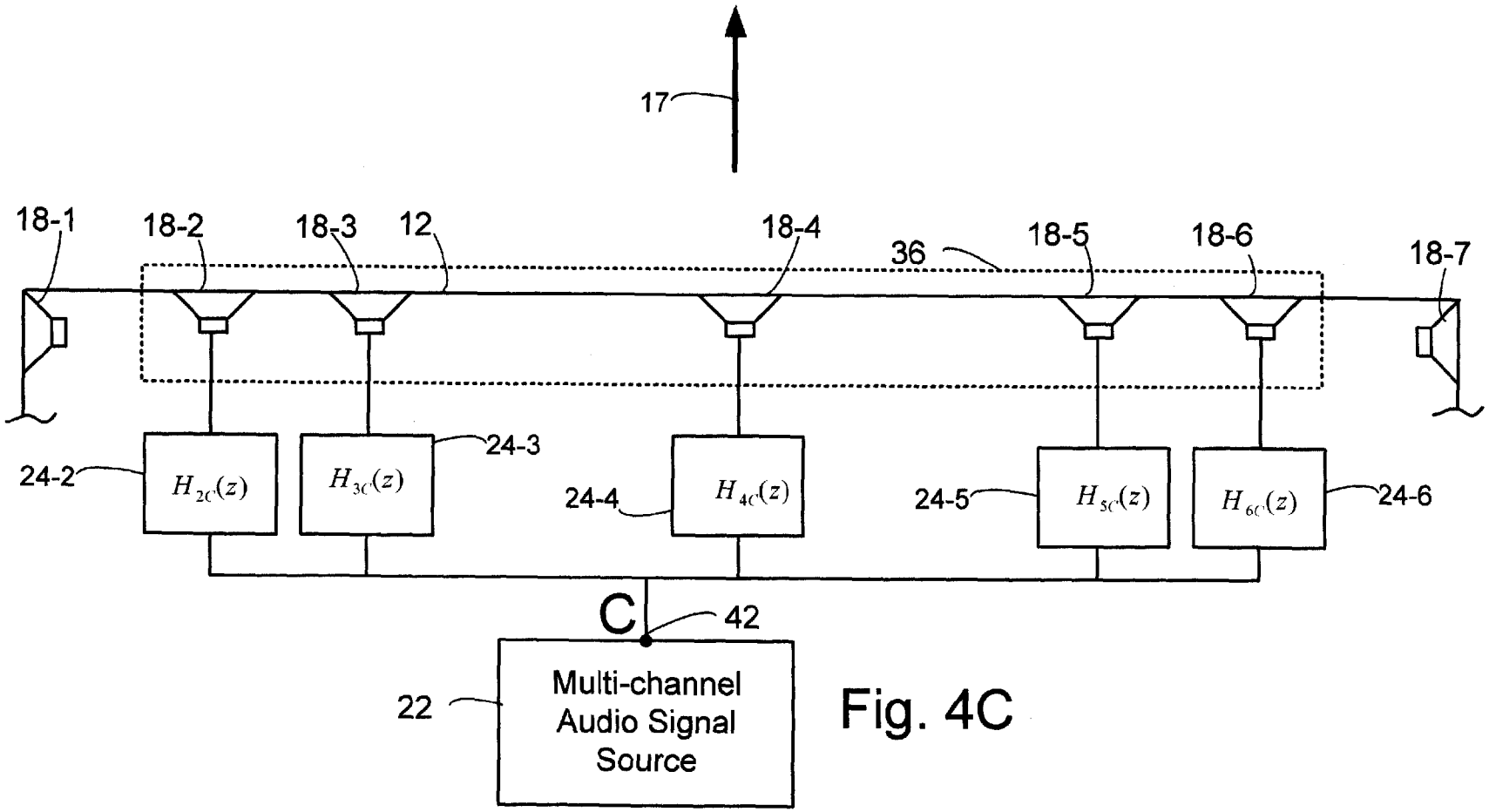

In FIG. 4C, the center channel array 36 includes acoustic drivers 18-2, 18-3, 18-4, 18-5, and 18-6. The acoustic drivers 18-2-18-6 are coupled to the center channel signal source 42 by signal processing circuitry 24-2-24-6, respectively that apply signal processing represented by transfer function $H_{2C}(z)$-$H_{6C}(z)$, respectively. The effect of the transfer functions $H_{2C}(z)$-$H_{6C}(z)$ may include one or more of phase shift, time delay, polarity inversion, and others. Transfer functions $H_{2C}(z)$-$H_{6C}(z)$ are typically implemented as digital filters, but may be implemented with equivalent analog devices.

In operation, the center channel signal C, as modified by the transfer functions $H_{2C}(z)$-$H_{2C}(z)$ is transduced to acoustic energy by the acoustic drivers 18-2-18-6. The radiation from the acoustic drivers interferes destructively and non-destructively to result in a desired directional radiation pattern.

Figure 4D:
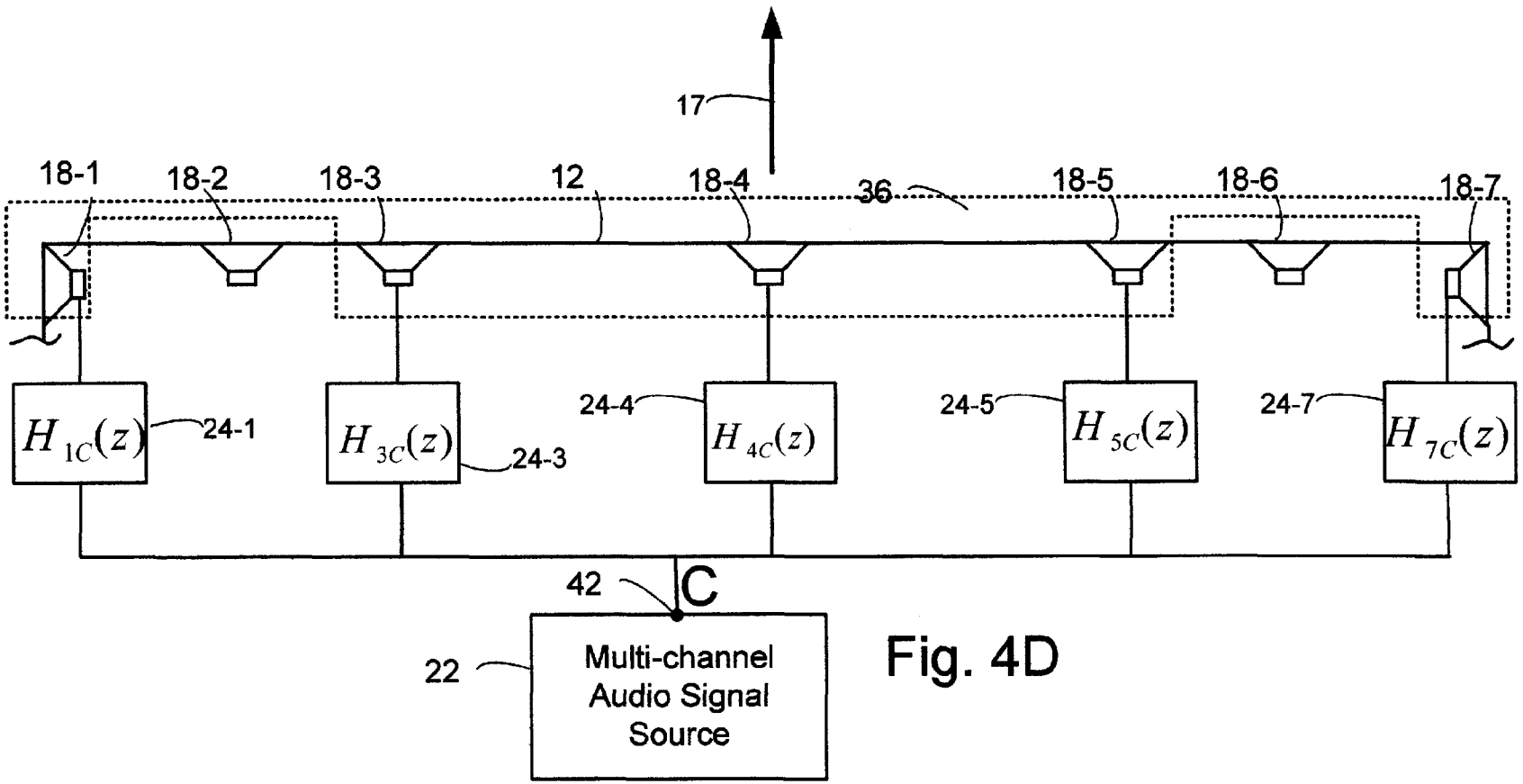

An alternative configuration for the center channel array is shown in FIG. 4D, in which the center channel array 36 includes acoustic drivers 18-1, 18-3, 18-4, 18-5, and 18-7. The acoustic drivers 18-1, 18-3-18-5, and 18-7 are coupled to the center channel signal source 42 by signal processing circuitry 24-1, 24-3-24-5, and 24-7, respectively that apply signal processing represented by transfer function $H_{1C}(z)$, $H_{3C}(z)$-$H_{5C}(z)$, and $H_{7C}(z)$, respectively. The effect of the transfer functions $H_{1C}(z)$, $H_{3C}(z)$-$H_{5C}(z)$), and $H_{7C}(z)$, may include one or more of phase shift, time delay, polarity inversion, and others. Transfer functions $H_{1C}(z)$, $H_{3C}(z)$-$H_{5C}$-(z)), and $H_{7C}(z)$ are typically implemented as digital filters, but may be implemented with equivalent analog devices.

In operation, the left channel signal C, as modified by the transfer functions $H_{1C}(z)$, $H_{3C}(z)$-$H_{5C}(z)$), and $H_{7C}(z)$ is transduced to acoustic energy by the acoustic drivers 18-1, 18-3-18-5, and 18-7. The radiation from the acoustic drivers interferes destructively and non-destructively to result in a desired directional radiation pattern.

The center channel array 38 of FIGS. 4C and 4D directs radiation upward, as indicated by arrow 17 and backward and cancels radiation toward the listener.

At high frequencies (for example, at frequencies with corresponding wavelengths less than three times the distance between the array elements), the stereo image may tend to "collapse" toward the more closely spaced acoustic drivers of the arrays. If the directional array has array elements in the center of the array are more closely spaced than the elements at the extremities (as in, for example, "nested harmonic" directional arrays or in logarithmically spaced arrays, for example as described in the van der Wal paper mentioned above), the stereo image will collapse toward the center of the array.

One way of preventing the collapse toward the center of the array is to form three arrays, one array of closely spaced elements adjacent the left end of the acoustic module, one at the center of the acoustic module, and one at the right end of the acoustic module. However, this solution requires many acoustic drivers, and is therefore expensive. For example, forming a five element left, center, and right channel arrays would require fifteen acoustic drivers.

An acoustic module according to FIGS. 4A-4D allows for left, center, and right arrays and greatly reduces the amount of collapse of the acoustic image toward the center of the array, with fewer acoustic drivers. Since the collapse tends to be toward the more closely spaced elements, if there is any collapse of the left channel is to the left end of the acoustic module 12 and if there is any collapse of the right channel, it is to the right end of the acoustic module 12 as opposed toward the middle of the acoustic image, which would be the case if the more closely spaced acoustic drivers were near the lateral middle of the acoustic module. Additionally, an audio system according to FIGS. 4A-4D provides a wider portion of the listening area that receives indirect radiation, and therefore has a more diffuse, pleasing stereo image, than an audio system with a directional array at the lateral middle of the television screen.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An audio system, comprising:

at least three acoustic drivers, arranged substantially in a line in a single enclosure, and separated by a non-uniform distance;

a first interference directional array, comprising a first subset of the plurality of acoustic drivers, for directionally radiating one of a left channel audio signal and a right channel audio signal; and signal processing circuitry to process audio signals to the first subset of acoustic drivers so that radiation from each of the acoustic drivers interferes destructively so that radiation in a direction toward a listening location is less than radiation in other directions; and a second interference directional array, comprising a second subset of the plurality of acoustic drivers, for directionally radiating the other of a left channel audio and a right channel audio signal; and signal processing circuitry to process audio signals to the second subset of acoustic drivers so that radiation from each of the acoustic drivers interferes destructively so that radiation in a direction toward a listening location is less than radiation in other directions;

the first subset and the second subset comprising at least one common acoustic driver, and the first subset including an acoustic driver not included by the second subset, and the second subset including an acoustic driver not included by the first subset.

2. An audio system according to claim 1, wherein the distance between the two outside leftmost acoustic drivers of the first directional array is less than the distance between any other two of the acoustic drivers of the first directional array and wherein the distance between the two rightmost acoustic drivers of the second directional array is less than the distance between any other two acoustic drivers of the second directional array.

3. An audio system according to claim 1, wherein the radiating surfaces of the acoustic drivers face upwardly.

4. An audio system according to claim 3, wherein the radiating surfaces of the acoustic drivers face upwardly and backwardly.

5. An audio system according to claim 1, wherein the radiating surface of the leftmost acoustic driver faces outwardly.

6. An audio system according to claim 1, further comprising an acoustically opaque barrier in front of the acoustic drivers.

7. An audio system according to claim 1, implemented in a television.

8. An audio system according to claim 1, further comprising:

a third interference directional array, comprising a third subset of the plurality of acoustic drivers in the single enclosure, for directionally radiating a center channel audio signal, the third subset including at least one acoustic driver not included by the first subset, at least one acoustic driver not included by the second subset, at least one acoustic driver in common with the first subset and at least one acoustic driver in common with the second subset; and signal processing circuitry to process audio signals to the third subset of acoustic drivers so that radiation from each of the acoustic drivers interferes destructively so that radiation in one direction is less than radiation in other directions.

9. A television, comprising an audio device, comprising:

at least three acoustic drivers, arranged substantially in a line in a common enclosure, and separated by a non-uniform distance;

a first interference directional array, comprising a first subset of the plurality of acoustic drivers, for directionally radiating one of a left channel audio signal and a right channel audio signal; and signal processing circuitry to process audio signals to the first subset of acoustic drivers so that radiation from each of the acoustic drivers interferes destructively so that radiation in a direction toward a listening location is less than radiation in other directions; and a second interference directional array, comprising a second subset of the plurality of acoustic drivers, for directionally radiating the other of a left channel audio and a right channel audio signal; and signal processing circuitry to process audio signals to the second subset of acoustic drivers so that radiation from each of the acoustic drivers interferes destructively so that radiation in a direction toward a listening location is less than radiation in other directions;

the first subset and the second subset comprising at least one common acoustic driver, and the first subset including at least one acoustic driver not included by the first subset and the second subset including at least on acoustic driver not included by the first subset.

10. A television according to claim 9, wherein the distance between the two leftmost acoustic drivers of the first directional array is less than the distance between any other two of the acoustic drivers of the first directional array and wherein the distance between the two rightmost acoustic drivers of the second directional array is less than the distance between any other two acoustic drivers of the second directional array.

11. A television system according to claim 9, wherein the radiating surfaces of the acoustic drivers face upwardly.

12. A television system according to claim 11, wherein the radiating surfaces of the acoustic drivers face upwardly and backwardly.

13. A television system according to claim 9, wherein the radiating surface of the leftmost acoustic driver faces outwardly.

14. A television system according to claim 9, further comprising an acoustically opaque barrier in front of the acoustic drivers.

15. A television system according to claim 9, further comprising:

a first interference directional array, comprising a third subset of the plurality of acoustic drivers, for directionally radiating a center channel audio signal; and signal processing circuitry to process audio signals to the third subset of acoustic drivers so that radiation from each of the acoustic drivers interferes destructively so that radiation in one direction is less than radiation in other directions.

* * * * *